US005425479A

United States Patent [19]

Credle, Jr.

[11] Patent Number: 5,425,479

[45] Date of Patent: Jun. 20, 1995

[54] VALVE FOR BAG-IN-BOX

[75] Inventor: William S. Credle, Jr., Stone Mountain, Ga.

[73] Assignee: The Coca-Cola Company, Atlanta, Ga.

[21] Appl. No.: 259,812

[22] Filed: Jun. 15, 1994

[51] Int. Cl.[6] ..... B65D 47/06

[52] U.S. Cl. ..... 222/548; 222/92; 222/553; 141/346; 141/348; 141/351; 251/149.9

[58] Field of Search ..... 222/92, 548, 553, 566; 141/346, 348, 349, 350, 351, 352, 353, 354, 355; 137/614.06; 251/95.5, 149.9

[56] References Cited

U.S. PATENT DOCUMENTS

| | | | |
|---|---|---|---|
| 350,454 | 10/1886 | Deverall | 222/548 |
| 2,489,746 | 11/1949 | Buneta | 141/351 X |
| 3,704,002 | 11/1972 | Skarzynski | 137/614.6 |
| 3,923,203 | 12/1975 | Anderson, Jr. | 222/548 X |
| 4,271,865 | 6/1981 | Galloway et al. | 251/89.5 |
| 4,286,636 | 9/1981 | Credle | 141/114 |
| 4,421,146 | 12/1983 | Bond et al. | 141/349 |
| 4,493,438 | 1/1985 | Rutter | 222/553 X |
| 4,564,132 | 1/1986 | Lloyd-Davies | 222/522 |
| 4,632,362 | 12/1986 | Lucking | 222/553 X |
| 4,653,672 | 3/1987 | Tuerk et al. | 222/553 X |
| 5,255,713 | 10/1993 | Schelle et al. | 137/614.04 |
| 5,271,111 | 12/1993 | Johenning | 141/352 X |

*Primary Examiner*—Andres Kashnikow
*Assistant Examiner*—Kenneth Bomberg
*Attorney, Agent, or Firm*—Thomas R. Boston

[57] ABSTRACT

A bag valve and spout for a bag-in-box bag wherein the bag valve is all plastic and recyclable. The bag valve is caused to rotate inside of the spout as a result of the hose connector being a screw threadedly connected to and disconnected from the bag valve. In the open position, holes in the bag valve align with holes in the spout, and vice versa for the closed position.

3 Claims, 2 Drawing Sheets

VALVE FOR BAG-IN-BOX

BACKGROUND OF THE INVENTION

This invention relates to a bag-in-box type of collapsible container and in particular to a spout and bag valve therefor.

Bag-in-box collapsible containers are well-known such as for use with soft drink syrup. Such bags include a spout providing a fill and dispenser opening in the bag and a bag valve which lockingly snaps into the spout. The bag valve includes a valve and is adapted to mate with a hose connector for supplying soft drink syrup to a postmix dispenser by means of a pump in the base line. The hose connector also includes a valve. When the hose connector is attached to the bag valve, both valves are caused to open, as described, for example, in U.S. Pat. No. 4,286,636.

The bag valve was made up of four separate elements; three of plastic and one of metal. The metal spring is a problem regarding recycling the bag-in-box bag.

SUMMARY OF THE INVENTION

A primary object of this invention is to eliminate the metal spring from the bag valve, to make it recyclable, and to make it less expensive.

The bag valve of this invention is a single molded plastic element. It includes a plurality of openings that do or do not line up with a plurality of openings in the spout, depending upon the rotational position of the bag valve inside of the spout. When the hose connector is attached to (screwed onto) the bag valve, it causes the bag valve to rotate to the open position. Likewise, removal of the hose connector causes the bag valve to rotate back to the closed position.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 3:
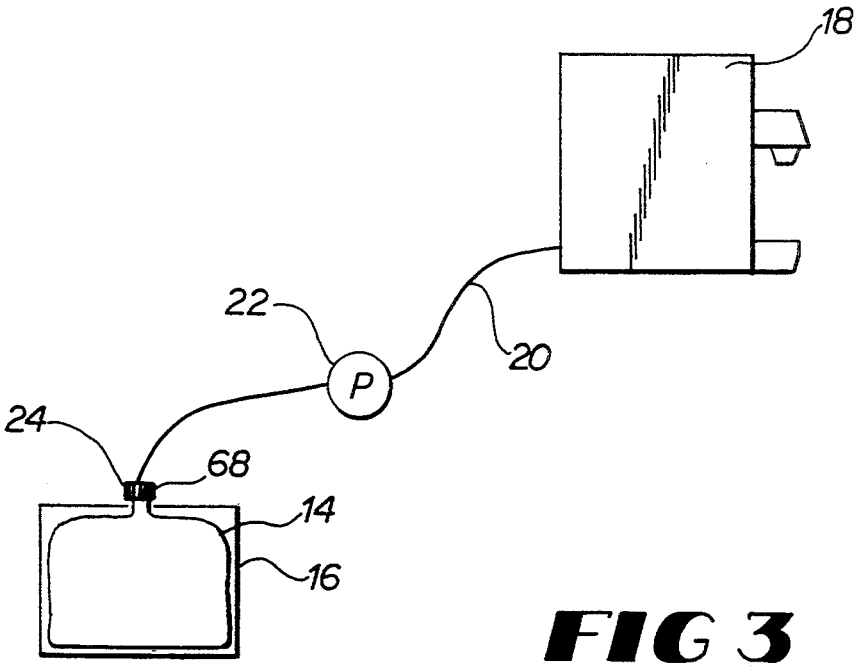
FIG. 3 is a diagrammatic view of this spout and bag valve as used in a postmix dispensing system.
Figure 4:
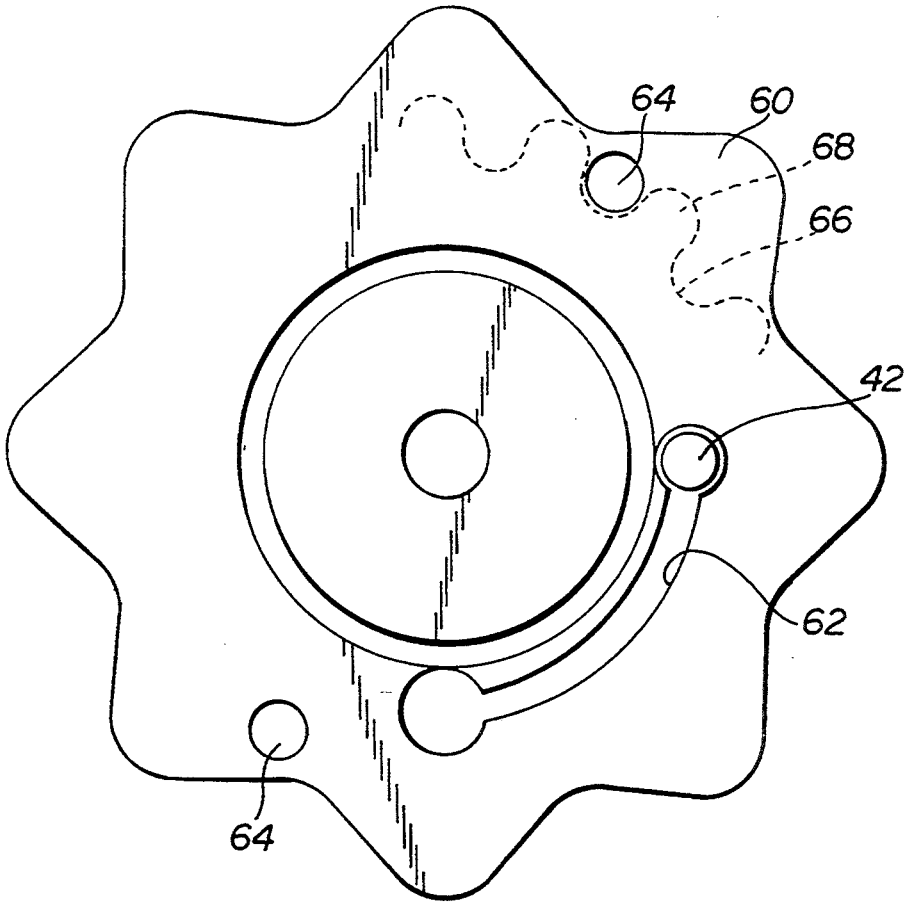
FIG. 4 is a partial plan view of the upper surface of the flange 60 of the bag valve.

With reference now to the drawings, FIGS. 1–4 show the spout 10 and bag valve 12 of this invention as connected to a bag-in-box bag 14. FIG. 3 shows the bag 14 in a box 16 for holding, for example, postmix soft drink syrup, for delivery to a fountain dispenser 18 through a hose 20 and pump 22. The hose 20 has a standard hose connector 24, with a one-way valve therein, on the end thereof and connected to the bag valve 12. When the hose connector is attached to the bag valve 12, its one-way valve and the bag valve 12 are caused to open.

The spout 10 includes a hollow cylindrical body having a liquid passageway 32 therethrough and a flat, annular connecting flange 34 bonded to the bag 14. The body 30 includes a hollow cylindrical skirt 36 extending down (down as used herein means into the bag 14) into the bag adjacent the inside surface of the flange 34. The skirt 36 includes a pair of syrup openings 38 therethrough. The body 30 also includes an upper, annular, radially extending shoulder 40 at the distal end of the body 30. For reasons that will become apparent below, an axially extending pin 42 is located on the upper surface 44 of the shoulder 40.

The bag valve 12 is of a size to fit into the spout in liquid tight relationship while still allowing the bag valve to rotate therein. The bag valve 12 includes a hollow cylindrical member 50 having an open upper distal end 52 and an inner, proximal, end 54 closed by an end wall 56.

Figure 1:
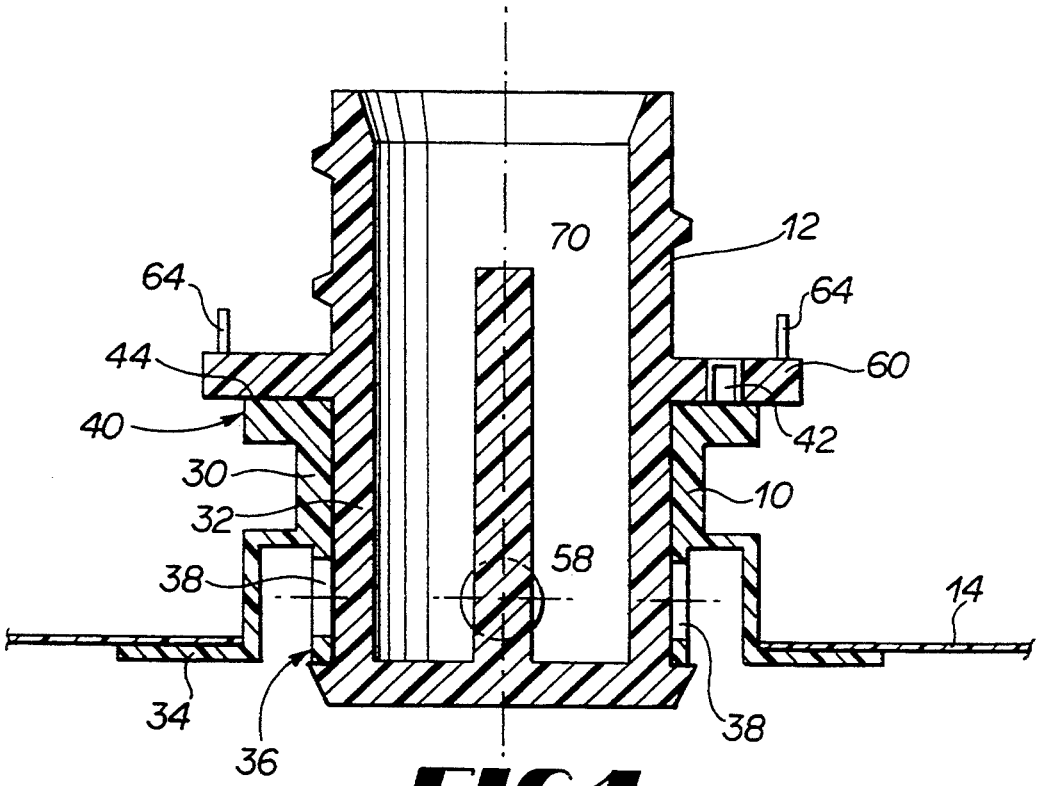
FIG. 1 is a cross-sectional view through the preferred embodiment of a spout and bag valve according to this invention, in their closed position.
Figure 2:
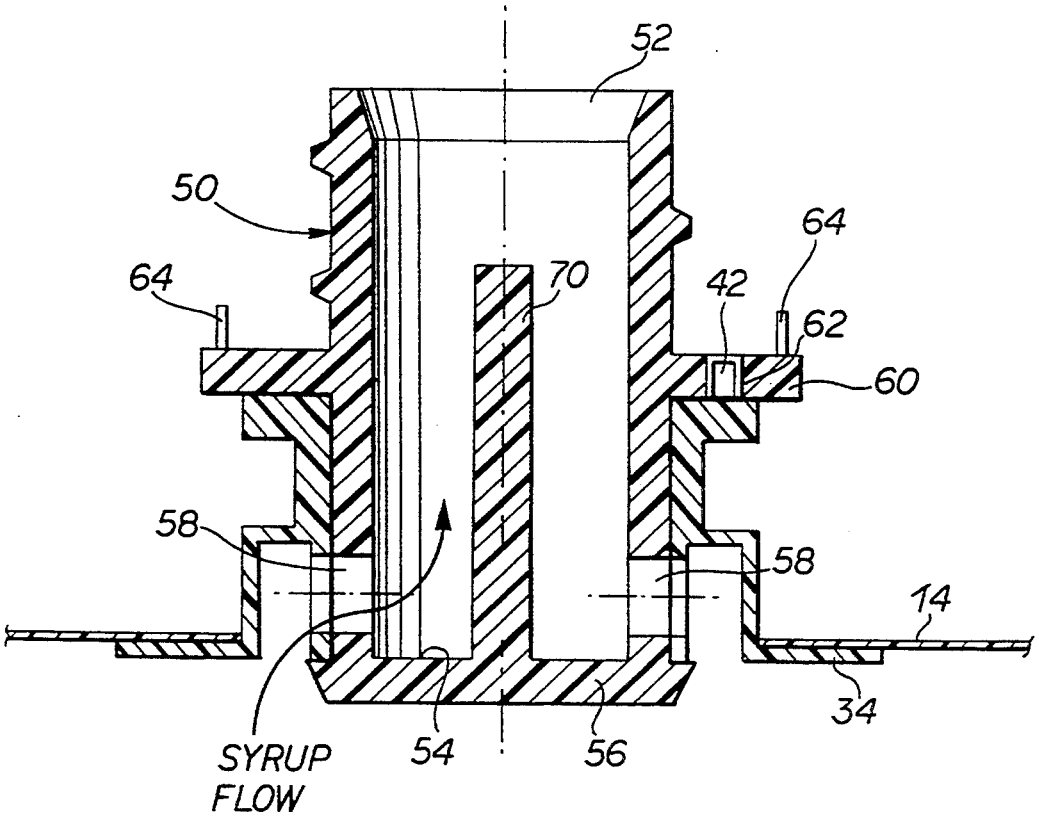
FIG. 2 is a view as in FIG. 1 but with the bag valve rotated to its open position.

The member 50 has a plurality of liquid openings 58 through the lower end thereof adapted to mate and align with the skirt openings 38 when the member 50 is in its open position (FIG. 2) and to be closed by the body 30 when the member 50 is in its closed position (FIG. 1).

The bag valve has an abutting flange 60 with an arcuate slot 62 for receiving the pin 42. The member 50 can be rotated back and forth between open and closed positions defined by the pin 42 reaching opposite ends of the slot 62.

The member 50 also has a locking shoulder 64 at its lower end which locks against the lower end of the skin 36 when the bag valve has been fully inserted into the spout 10. This locking engagement along with the flange 60 abutting against the shoulder 40 prevent any relative axial movement of the spout and bag valve.

A standard hose connector 24 is screw threadingly attached to the bag valve 12. The hose connector has a valve which is caused to open by a pin 70 connected to the end wall 56 in a known manner. As the hose connector is attached, it abuts flange 60 and can go no further, causing, if not before, the bag valve to rotate from its closed to its open position. When the hose connector is disconnected, one of the valleys 66 between the ribs 68 receives a finger 64 extending upwardly from the upper surface of the flange 60 which causes the bag valve 12 to rotate from the open to the closed position.

While the preferred embodiment of this invention has been described above in detail, it is to be understood that variations and modifications can be made therein without departing from the spirit and scope of the present invention.

What is claimed is:

1. A one piece molded plastic spout for a bag-in-box bag comprising:

(a) a hollow cylindrical body having a liquid passageway therethrough;

(b) a flat, annular, ring shaped connecting flange having an inside surface and an outside surface, said flange extending radially out from said cylindrical body in a plane perpendicular to the axis of said passageway;

(c) said body including a hollow cylindrical skirt extending down from said body adjacent said inside surface of said flange;

(d) a plurality of separate, spaced apart liquid openings extending through said skin;

(e) said body including an upper, annular, radially extending shoulder at its distal end; and (f) an axially extending pin located on the upper surface of said shoulder.

2. The spout as recited in claim I including in combination therewith:

(a) a bag valve lockingly connected to said spout and rotatingly mounted in said body passageway;

(b) said bag valve including a hollow cylindrical member in rotatable liquid-tight contact with said body and having an open upper distal end and an inner proximal end closed by an end wall;

(c) said member having a plurality of liquid openings through said proximal end thereof adapted to mate and align with said skin openings when said member is rotated to its open position and to be closed by said body when said member is rotated to its closed position;

(d) said bag valve and spout having mating locking means for holding said valve and spout together against axial movement therebetween; and (e) said member having a radially extending abutting flange in contact with said shoulder of said body, and said abutting flange having an arcuate slot therein receiving said pin, whereby said bag valve can be rotated from a closed position wherein said pin is at one end of said slot, to an open position wherein said pin is at the other end of said slot.

3. The combination spout and bag valve as recited in claim 2 wherein the outside surface of said bag valve member above said abutting flange is a screw thread for mating with a hose connector, and including means on the upper surface of said abutting flange for locking to a hose connector for causing said bag valve to rotate.

* * * * *